United States Patent [19]

Chiesa

[11] Patent Number: 4,789,158

[45] Date of Patent: Dec. 6, 1988

[54] GOLF CLUB VISUAL AID DEVICE

[76] Inventor: David J. Chiesa, 799 E. Illinois St., Lake Forest, Ill. 60045

[21] Appl. No.: 47,317

[22] Filed: May 8, 1987

[51] Int. Cl.[4] ..... A63B 53/00

[52] U.S. Cl. ..... 273/163 A; 273/183 D; 273/183 E

[58] Field of Search ..... 273/163 A, 163 R, 164, 273/183 R, 183 D, 186 R, 186 A, 183 E

[56] References Cited

U.S. PATENT DOCUMENTS

| | | | |
|---|---|---|---|
| 2,723,125 | 11/1955 | Comee | 273/186 |
| 2,898,109 | 8/1959 | Williams | 273/163 |
| 3,118,678 | 1/1964 | Rohr | 273/163 |
| 3,198,525 | 8/1965 | Smith | 273/163 |
| 3,273,892 | 9/1966 | Nolting | 273/163 |
| 3,273,893 | 9/1966 | Duncan | 273/163 |
| 3,292,928 | 12/1966 | Billen | 273/163 |
| 3,298,693 | 1/1967 | Eisenberg | 273/183 D |
| 3,495,834 | 2/1970 | Tanczos | 273/163 |
| 3,529,830 | 9/1970 | Palotsee | 273/163 |
| 3,667,761 | 6/1972 | Palotsee | 273/163 |
| 3,698,093 | 10/1972 | Marshall | 263/273 |
| 3,951,415 | 4/1976 | Stuart | 273/183 |
| 4,002,343 | 1/1977 | Eckert | 273/163 |
| 4,167,268 | 10/1979 | Lorang | 273/163 A |
| 4,174,838 | 11/1979 | Paschetto | 273/163 A |
| 4,291,883 | 9/1981 | Smart et al. | 273/163 |

FOREIGN PATENT DOCUMENTS

| | | | |
|---|---|---|---|
| 708084 | 4/1965 | Canada | 273/163 A |

*Primary Examiner*—Richard C. Pinkham
*Assistant Examiner*—William E. Stoll
*Attorney, Agent, or Firm*—Hill, Van Santen, Steadman & Simpson

[57] ABSTRACT

A light-weight sighting or aiming device for showing the line of the path of a golf ball to be impacted by a golf club has a base head adapted to be releasably secured to the shaft of the club at a selected distance above the club head, a rod projecting forwardly from the base head to be aligned parallel with the club head, a pointer selectively mounted at different positions along the length of the rod normal to the axis of the rod and threads on the rod to extend and retract the rod relative to the base head so that the pointer will be positioned over the sweet spot of the hitting face when the golfer addresses the ball. The component parts of the device are preferably light-weight plastics material with the base head having an end spaced for gripping the shaft and with the rod member frictionally threaded for a substantial distance in the base head member. The preferred rod has a plurality of transverse holes therethrough spaced along its length to selectively snugly receive the pointer. The device only weighs about ½ ounce and requires no alteration of the club so that it will have no effect on the feel of the club.

12 Claims, 2 Drawing Sheets

GOLF CLUB VISUAL AID DEVICE

BACKGROUND OF THE INVENTION

1. Field of the Invention

This invention relates to the art of sighting or aiming devices for golf clubs and particularly deals with a light- weight device easily attached to and removed from the shaft of a golf club, preferably a putter, to be used during practice for teaching the proper use of the club without changing its feel.

2. Prior Art

Many types of sighting or aiming devices have been proposed for golf clubs. These devices are generally cumbersome, heavy, permanently fixed to the club and intended for use during play, and change the feel of the club. The art of sighting or aiming devices for golf clubs is especially deficient in providing the user with an easily attached and removed very light weight practice device that does not change the feel or construction of the golf club and is easily adjustable without tools to accommodate different types of clubs.

It would therefore be an improvement in this art to provide a light weight detachable aiming or sighting device for golf clubs, particularly putters, which shows the correct sight line for the intended path of the ball, teaches an on-line back swing and follow-through, shows the tilt deviation of the hitting face and develops a consistent grooved stroke without in any way changing the feel of the club.

SUMMARY OF THE INVENTION:

This invention provides a training device easily attached to and removed from the shaft of a golf club which is adjustable to accommodate different types of clubs without in any way changing the feel of the club and sighting the line of travel for the ball and the fore-to-aft position of the club head. The device is effective to concentrate the golfer's attention to develop a grooved stroke.

The preferred device includes a base head fitted on the club shaft near the head or blade, a rigid rod threaded in the base projecting over the head or blade parallel with its longitudinal axis and a direction indicator pin selectively seated in spaced holes along the length of the rod to project fore and aft therefrom normal to the hitting face. The base has a bifurcated rear end embracing the shaft or hosel to position it at a level above the club head or blade where it will tightly grip the shaft or hosel and will not move on the shaft even when the club is accelerated during a stroke. Since the shafts and hosels of different types of clubs will vary in diameter and may be tapered or stepped along their length, the shaft gripping level of the base will vary with different clubs. The bifurcated end of the base may be resilient to snap on the shaft or hosel or may be relatively rigid to initially loosely embrace a reduced diameter portion and then moved to a level tightly gripping an increased diameter portion of the shaft or hosel.

The base projects normal to the axis of the shaft or hosel on which it is mounted and is rotated to extend forwardly for positioning the projecting rod threaded therein parallel with the longitudinal axis of the club head or hitting face.

Since golf clubs have "sweet spots" varying in distance from the shaft or hosel and since it is desired to have the direction pin of the device on a sight line overlying the sweet spot, the rod has a number of transverse holes at spaced intervals along its length so that the pin may be inserted through a hole positioning the pin on a sight line close to, but of course, spaced above the "sweet spot". Then the rod can be rotated to thread it further into or out of the base thus providing a micrometer adjustment to exactly position the pin over the sweet spot and parallel with the ground when the club is correctly addressed to the ball.

A preferred sighting or aiming device of this invention weighs less than one ounce, preferably in the order of ½ ounce. All of its components are made of plastics material such as a polyolefin, a polyvinyl chloride, Nylon, Dacron or the like. The base head is about 1 to ½ inches long, and has a diameter of about ½ to ¾". The rod is about 3 to 4" long with a diameter of about ⅛ to 3/16". The pointer or indicator pin is about 7 to 10" long with a diameter of about 1/16 to 3/32". The thread of the base may extend through its length or only part way to provide for retraction and extension of the rod in the order of about ½ to ¾". The holes through the rod are spaced apart about ½ to 1" with the outermost hole spaced inward from the free end of the rod about ¼ to ¾" thus providing a right angle cross arm intersection of rod and pin. The diameter of the holes is such as to snugly receive the pointer pin and grip it in fixed position. The pointer pin preferably extends equal distances from both sides of the rod.

It is then an object of this invention to provide a practice light weight aiming or sighting device for golf clubs which does not alter the feel of the club.

Another object of this invention is to provide a sighting and aiming device for golf clubs which is easily attached to and removed from the shaft or hosel of the club adjacent the club head to overlie the sweet spot of the head in the line of sight of the golfer when addressing the ball and indicating the intended path of the ball.

A further object of the invention is to provide a sighting aid for golf club putters which is so light in weight as to not change the feel of the putter and which shows the line of travel of the golf ball to the hole, the fore-to-aft position of the putting face and the path of the stroke of the putter.

Another object of this invention is to provide a feather-weight practice attachment for golf club putters which is easily attached to and removed from the shaft or hosel of the putter club to point out the stroke of the club, the inclination of the club head and the travel path of the ball to the cup.

A still further object of this invention is to provide a putter aiming device composed of light weight plastic components including a base to be removably secured to the shaft or hosel of the putter, a rod projecting from the base parallel with the longitudinal axis of the putter head and a pointer pin selectably carried by the rod to overlie the sweet spot of the putter head in the line of sight of the golfer when addressing the ball.

A specific object of the invention is to provide an aiming device for golf club putters which is easily applied to and removed from different types of putters and is adjustable to provide a sight line for the path of the ball to the cup.

Another specific object of this invention is to provide a golf club aiming device composed of separable light-weight plastic components quickly assembled in storage or use positions.

Other and further objects of this invention will become apparent to those skilled in this art from the following detailed description of the annexed sheets of drawings which show a preferred mode embodiment of the invention as used on a golf club putter.

ON THE DRAWINGS

AS SHOWN IN THE DRAWINGS

Figure 1:
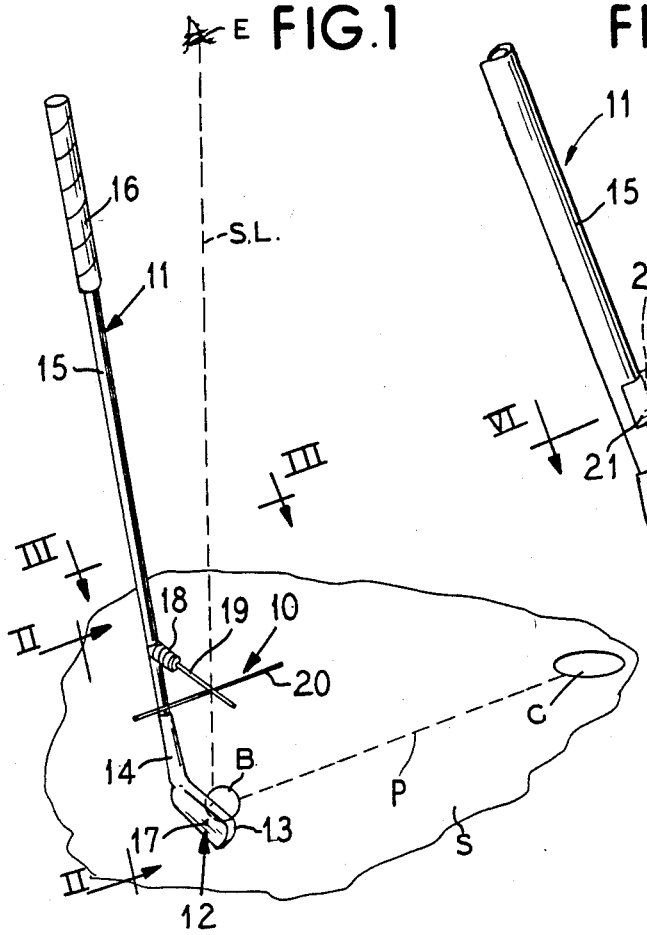
FIG. 1 is an environmental perspective view of a sighting device of this invention mounted on a putter and indicating the path of the ball to the cup.

The reference numeral 10 indicates generally a sighting or aiming device of this invention. As shown in FIG. 1, the device 10 is mounted on a blade type putter 11 which has a blade head 12 with an upright front putting face 13 along the length thereof, and an upwardly and rearwardly inclined hosel 14 at the heel end thereof. A club shaft 15 is secured at its lower end in the hosel 14 and a hand grip 16 is provided on the upper end of the shaft. The blade head 12 has a sweet spot 17 about midway between the toe and heel ends of the blade and substantially forwardly of the hosel 14. The club 11 is illustrated in position addressing a golf ball B on the putting surface S for impact to travel along a path P to the cup C.

The device 10 of this invention is mounted in position on the lower end of the club shaft 15 to intersect the sight line S.L. between the eye E of the golfer addressing the ball B and the axis of the sweet spot 17 for indicating to the golfer the path P and the line of the putting stroke as well as the open or closed position of the putting face 13.

The device 10 includes a base head 18 detachably mounted on the shaft 15 adjacent the hosel 14, a rigid rod 19 carried by the base 18 and projecting axially therefrom, overlying and parallel to the putting face 13. A pointer or indicator pin 20 is carried by the rod 19 at right angles thereto to overlie the sweet spot axis of the blade 12. The pointer 20 will be parallel with the putting surface when the putting face 13 of the blade head is in vertical position.

Figure 2:
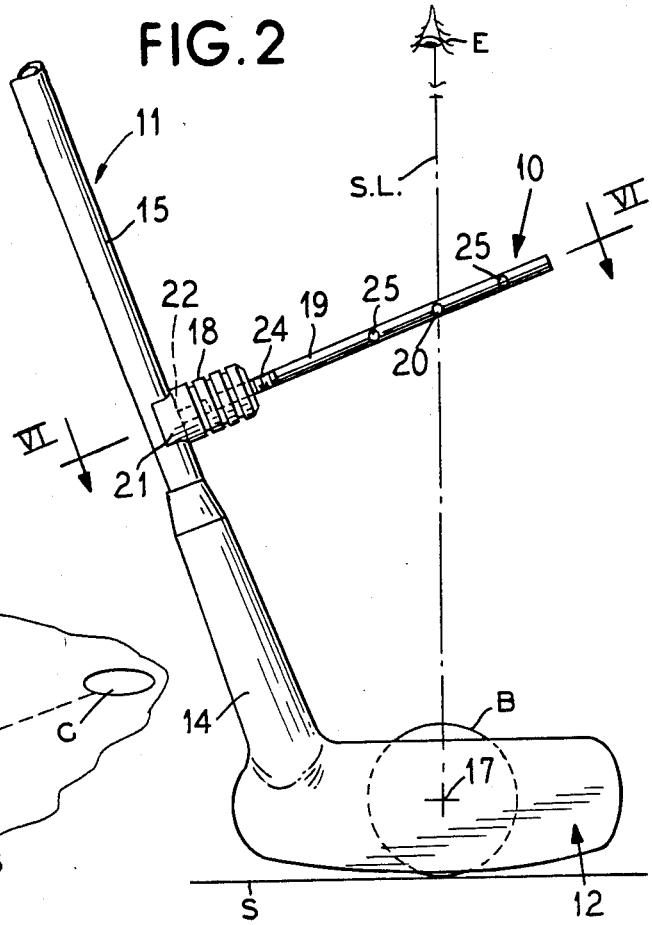
FIG. 2 is a fragmentary rear elevational view along the line II—II of FIG. 1 on a larger scale.
Figure 3:
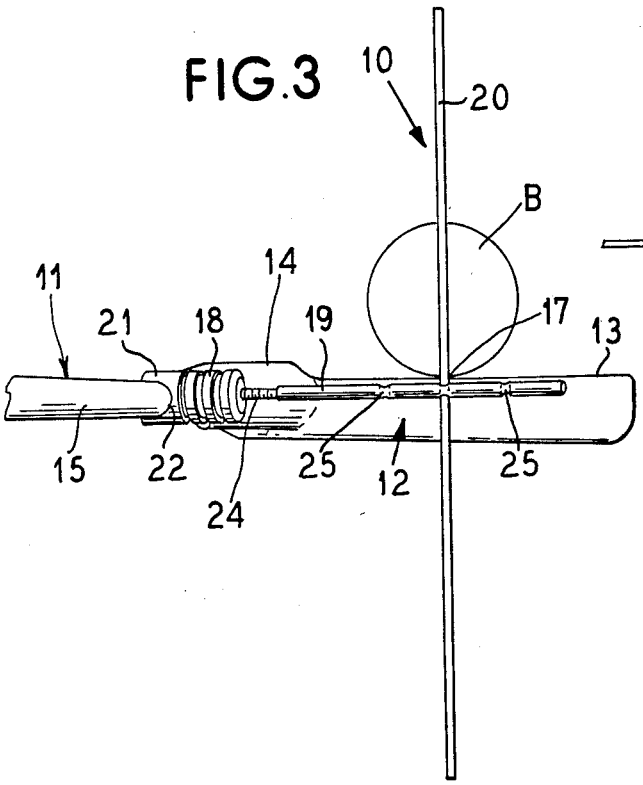
FIG. 3 is a top cross sectional view along the line III—III of FIG. 1 on a larger scale.
Figure 4:
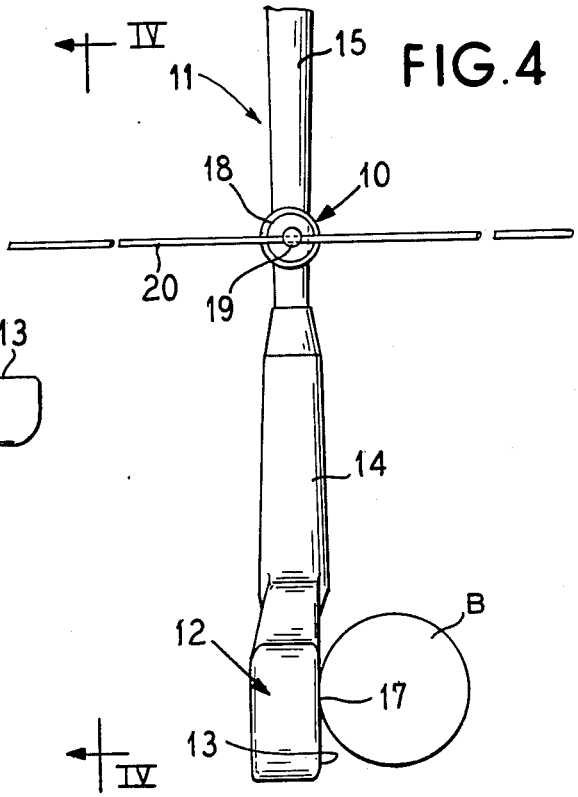
FIG. 4 is a front or toe end elevational view taken along the line IV—IV OF FIG. 3.

As shown in FIG. 2, when the putter head 12 is bottomed on the putting surface S, the hosel 14 and shaft 15 will extend upright from the heel end of the head at an angle to the vertical which may vary in different putters. Some putters have a head with a longitudinal arcuate bottom face permitting rocking on the putting surface and tilting the shaft when addressing the ball.

The device 10 fits on the shaft 15 and in some instances on the hosel 14 to project forwardly at right angles to the shaft or hosel axis. Thus, as illustrated in FIG. 2, the device tilts forwardly and upwardly over the blade 12.

The base 18 is preferably a rigid cylindrical member with a bifurcated rear end 21 defining a fragmental cylindrical recess 22 embracing more than half the circumference of the shaft or hosel to secure the base in position. This bifurcated end 21 may be resilient to snap on the shaft or hosel or may be rigid and secured to the shaft or hosel by sliding it to a level where it will tightly grip the shaft or hosel.

Figure 6:
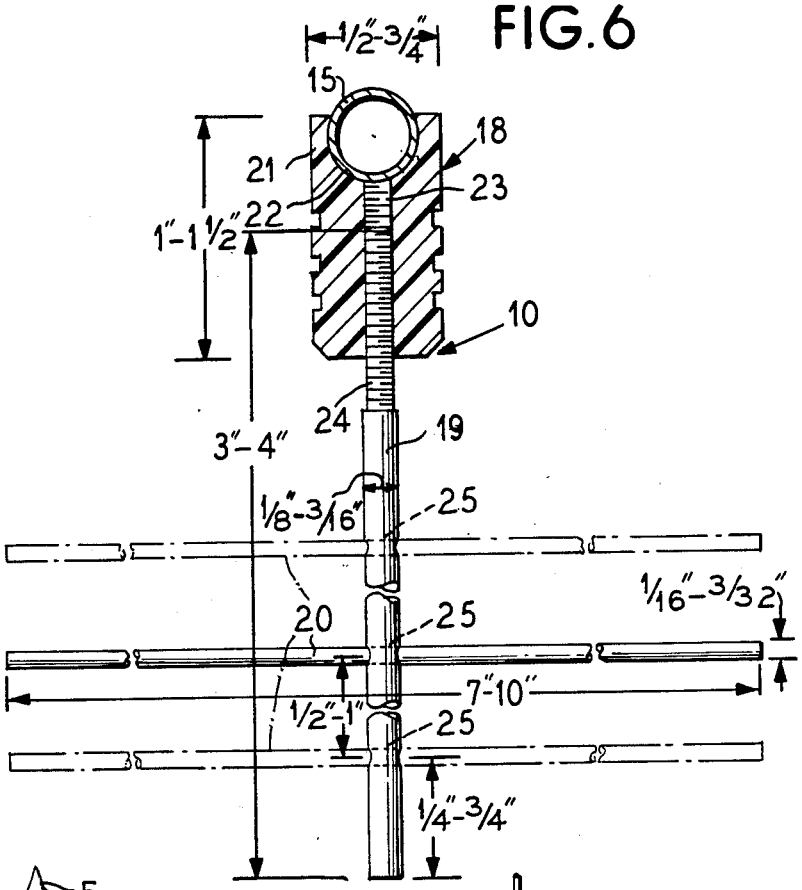
FIG. 6 is a cross sectional view along the line VI—VI of FIG. 2 and illustrating alternate positions for the indicator pointer on the support rod.

As shown in FIG. 6, the base head 18 has an axial internally threaded hole 23 which may extend from the front end of the head to a desired depth therein or completely through the head to the recess 22 at the rear end thereof.

The rod 19 has a threaded rear end 24 tightly mated with the threaded hole 23 so as to be threaded in the hole to a desired depth and remain at this depth until again rotated by the golfer.

The rod 19 has a plurality of transverse holes 25 at spaced intervals along the length thereof. These holes selectively receive the indicator pin 20. The outermost hole 25 is preferably spaced inboard from the free outer end of the rod 19 so that the rod will project beyond the pin providing a right angle cross pin and rod indicator with the pin extending directly over the path P in alignment therewith and the rod extending at right angles to this path.

Figure 5:
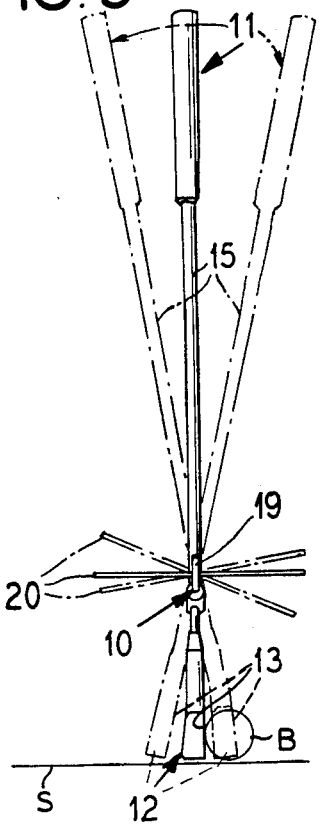
FIG. 5 is a view similar to FIG. 4 but illustrating the manner in which the device sights the plane of the putting face of the putter.

The hole 25 selected for the pin 20 is such as to place the pin close to the sight line S.L. from the golfer's eye E to the sweet spot 17 of the putter head or blade 12. The rod 19 is then threaded into or out of the base head 18 providing a micrometer adjustment that will position the indicator pin 20 to intersect the sight line S.L. When these adjustments have been made, the device is then in position to show not only the path P, but also the opened or closed position of the putter face 13 as illustrated in FIG. 5. Thus, when the club shaft 15 is tilted forwardly to provide a closed putting face 13, the pointer 20 will tilt downwardly toward the putting surface S. If the club shaft is tilted rearwardly to provide an open putting face, the pointer 20 will be inclined upwardly.

Figure 7:
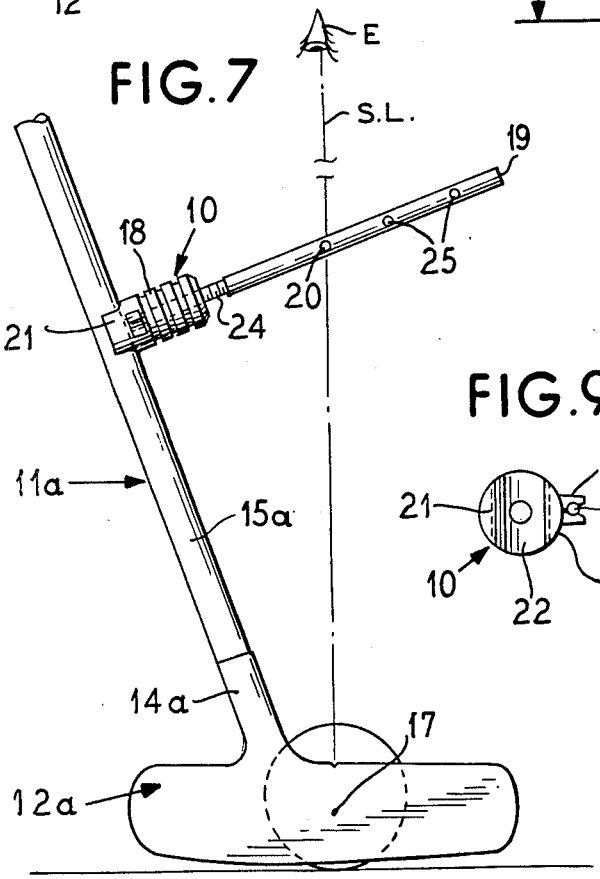
FIG. 7 is a view similar to FIG. 2, but illustrating the device mounted on a putter having its hosel and shaft closer to the sweet spot of the putter head.

As shown in FIG. 7, the device 10 is illustrated as mounted on another type of putter **11*a* having a blade 12*a* with a hosel 14*a* extending from the top thereof forwardly from the heel, thus positioning the shaft 15*a* closer to the sweet spot 17. With this type of putter, the device 10 is mounted on the shaft 15*a* higher than on the club 11 to provide a sufficient gap between the shaft axis and the sight axis S.L. so that when the pin 20 is mounted in the innermost hole 25 of the rod it will intersect this sight line to the sweet spot 17**.

Figure 8:
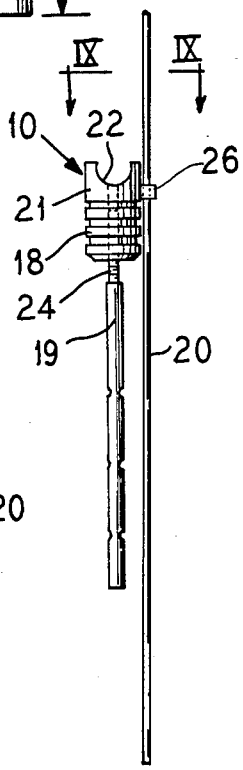
FIG. 8 is a side elevational view indicating the manner in which the components of the device may be mounted for storage.
Figure 9:
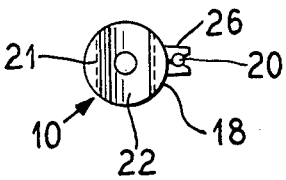
FIG. 9 is a top end view along the line IX—IX of FIG. 8.

As illustrated in FIGS. 8 and 9, the base head 18 may be provided with a bifurcated side lug 26 to snugly receive the pin 20 in a storage position alongside the head 18 and rod 19. Thus, the device 10 can be disassembled and carried in a compact condition for placing in a storage compartment of a golf bag or the like.

While the drawings specifically show the use of the device 10 on a putter, it will be understood that the invention is not limited to such use since the device is useful on other types of golf clubs such as irons having a lofted hitting face.

As used in the claims, the term "shaft" includes the shaft and the hosel of the club head to which the shaft is fitted.

From the above descriptions it should be readily understood by those skilled in this art that this invention advances the art to provide the golfer with an effective sighting tool which in no way changes the structure or feel of his golf club and provides for the self teaching of a correct stance and stroke.

I claim as may invention:

1. An indicator for detachably mounting on a shaft of a golf club to show the line of travel of a golf ball to be impacted by the sweet spot area of the hitting face of the club and deviation in tilt of this hitting face relative to the ground which comprises a base head having means for detachably mounting on a golf club shaft, a rod projecting axially forward from said head, a pin selectively mounted at intervals along the length of the rod to project normal to the rod and extend fore and aft of the rod to provide a sighting line extending on both sides of said rod, means for retracting the rod into and out of the head to finely adjust the position of the pin for overlying the sweet spot of the putting face, and said rod and pin being free from any visual obstruction other than the pin and rod themselves.

2. The device of claim 1 wherein the means for retracting the rod into and out of the head are a threaded axial hole in the head and an external thread on the inboard end of the rod.

3. The indicator of claim 1 wherein the means for detachably mounting the base head on the club shaft is a bifurcated rear end on the head embracing more than half of the circumference of the shaft in frictional gripping relation.

4. The indicator of claim 1 wherein the selective mounting for the pin is a series of longitudinally spaced transverse holes in the rod along the length thereof.

5. The indicator of claim 4 wherein the outboard hole of the rod is spaced inboard from the end of the rod to provide a right angle cross arm relationship of the pin and rod even when the pin is mounted in this outboard hole.

6. The indicator of claim 1 wherein the total weight of its components does not exceed 1 ounce.

7. The indicator of claim 1 wherein the pin is substantially longer than the rod.

8. The indicator of claim 1 wherein the base has means for detachably mounting the pin alongside the rod to provide a storage assembly for the components.

9. The device of claim 1 having a total weight in the order of ½ to 1 ounce.

10. The device of claim 1 wherein the base is about 1 to 1½" long, has a diameter of about ½ to ¾", the rod is about 3 to 4" long and has a diameter of ⅛ to 3/16" and the pin is about 7 to 10" long with a diameter of about 1/16 to 3/32".

11. A light-weight practice device for attachment to the shaft of a golf club having a shaft and a head with a sweet spot for impacting a golf ball without changing the feel of the club which comprises a base having means for detachably mounting on the club shaft to extend forwardly from the shaft, a rigid rod threaded into the base to a selected depth, said base being positioned on the shaft to carry the rod in overlying parallel relation with the head of the club in spaced relation above the head, said rod having a plurality of transverse holes spaced along the length thereof, an elongated direction indicator pin selectively and directly snugly fitted and gripped in a hole of the rod at right angles to the rod axis to intersect a sight line between the sweet spot of the head and the eyes of a golfer addressing the club to a ball, said indicator pin being substantially longer than the rod and having substantially equal lengths extending fore and aft of the rod, and the threaded connection of the rod with the base accommodating longitudinal shifting of the rod to position the pin directly on the sight line.

12. The device of claim 11 including means for detachably securing the pin to the base in a compact storage position.

* * * * *